US007464759B1

(12) United States Patent
Wintill et al.

(10) Patent No.: US 7,464,759 B1
(45) Date of Patent: Dec. 16, 2008

(54) METHOD FOR FLOWING FLUID INTO OR FROM A WELL

(75) Inventors: Charles David Wintill, Houston, TX (US); Rodney Wayne Long, Cypress, TX (US); William Ryle Darnell, St. Martinville, LA (US); William John Darnell, Houston, TX (US); Michael Chad Darby, Katy, TX (US)

(73) Assignee: PetroQuip Energy Services, LLP, Houston, TX (US)

( * ) Notice: Subject to any disclaimer, the term of this patent is extended or adjusted under 35 U.S.C. 154(b) by 31 days.

(21) Appl. No.: 11/742,394

(22) Filed: Apr. 30, 2007

(51) Int. Cl.
*E21B 43/20* (2006.01)

(52) U.S. Cl. ..... 166/305.1; 166/319

(58) Field of Classification Search ..... 166/305.1, 166/319, 316
See application file for complete search history.

(56) References Cited

U.S. PATENT DOCUMENTS 6,983,796 B2 1/2006 Bayne et al.
7,392,839 B1 * 7/2008 Wintill et al. ..... 166/66.7

* cited by examiner

*Primary Examiner*—Jennifer H Gay
*Assistant Examiner*—Brad Harcourt
(74) *Attorney, Agent, or Firm*—Buskop Law Group, P.C.; Wendy Buskop

(57) ABSTRACT

A method for injecting fluid into a well or producing fluid from a well comprising providing one or more single fluid line sliding sleeve downhole tool assemblies into a well in a closed position, applying a first pressure from a fluid source simultaneously to open at least one of the single fluid line sliding sleeve downhole tool assemblies, and allowing fluid to move into tubing or into a reservoir. The method contemplates the use of multiple single fluid line sliding sleeve downhole tool assemblies, wherein the first pressure causes only one of the tool assemblies, or one operably connected plurality of tool assemblies, to be in an open position at any time.

27 Claims, 14 Drawing Sheets

METHOD FOR FLOWING FLUID INTO OR FROM A WELL

FIELD

The present embodiments generally relate to a method for flowing fluid into or from a well using a single line single fluid line sliding sleeve downhole tool assembly for drilling operations.

BACKGROUND

During production of hydrocarbons from a well, operators may find it necessary to either open a port within a tubular string or close a port within a tubular string. A valve placed in a tubular string can be used to establish communication with the reservoir, or alternatively, to shut-off communication with the reservoir. Several devices have been developed over the years to accomplish the opening and/or closing of ports within tubular strings.

These devices are generally known as sliding sleeves due to the ability of the devices to shift an inner sleeve from a first position to a second position. Sliding sleeves are commercially available from several vendors. One type of sliding sleeve that is commercially available is sold under the name "Otis DuraSleeve" and may be purchased from Halliburton Corporation.

A need exists for a device that can be selectively opened and closed in a well. There is also a need for a device that can be shifted from a closed position to an open position, or alternatively from an open position to a closed position, without harming the seal assembly. There is also a need for a seal assembly within a downhole device that will continue to provide a seal after multiple openings and closings of the downhole device.

The present embodiments meet these needs.

BRIEF DESCRIPTION OF THE DRAWINGS

The detailed description will be better understood in conjunction with the accompanying drawings as follows.

Figure 1:
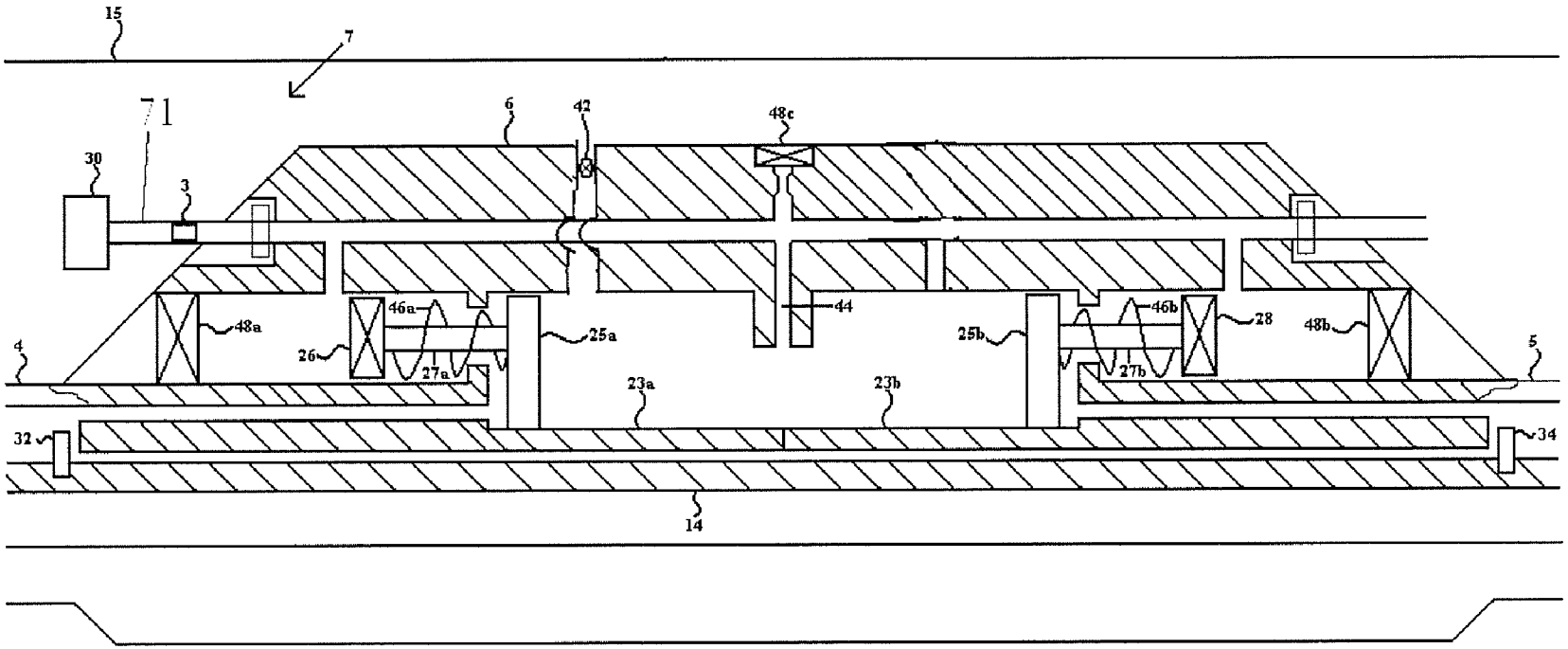
FIG. 1 depicts a cross sectional view of a central section of an embodiment of a single fluid line sliding sleeve downhole tool assembly.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

One advantage of the present method is that the present method can utilize sliding sleeve downhole tool assemblies capable of operation using only a single fluid line. Each single fluid line sliding sleeve downhole tool assembly includes one or more slotted logic drums, with slots arranged so that pressure from a fluid line can actuate every tool assembly within a well, while permitting the tool assemblies within only one zone of a reservoir to be in an open position at any time. Thus, with only a single fluid line, a multitude of sliding sleeve tool assemblies can be individually opened and closed, permitting the injection of fluid to or the production of hydrocarbons or water from different reservoir zones individually.

A further advantage is that the single line single line sleeve downhole tool assemblies can withstand extreme temperatures and pressures, such as those found within an oil or natural gas well while retaining effective seals and valves.

The single line single fluid line sliding sleeve downhole tool assemblies can selectively be shifted between open and closed positions under well conditions without causing damage to the assembly, or any seals or components within the assembly, providing an assembly with an improved product life over existing sliding sleeves.

The single line single fluid line sliding sleeve downhole tool assemblies utilize parts and materials uniquely suitable to maintain their tensile strength at high temperatures, and further utilize an arrangement of parts and components that allows the tool assemblies to maintain operation in high temperature and high pressure conditions.

The present method provides improved safety over other methods through the use of equipment that maintains its functionality and stability under extreme conditions, such as those within a well.

The present method provides improved cost and efficiency through use of only a single fluid line to control multiple sliding sleeve downhole tool assemblies, and through the use of durable equipment that maintains its functionality and stability, preventing the need for costly maintenance and replacement, and preventing the costs associated with halting production while performing maintenance and replacement.

One embodiment of the present method relates to a method for injecting fluid into an oil, natural gas, or water reservoir.

The present embodiment includes providing at least one single fluid line sliding sleeve downhole tool assembly into a well. It is contemplated that the single fluid line sliding sleeve downhole tool assembly can be inserted in a closed position when provided into a well. However, it is also contemplated that an operator could provide a single fluid line sliding sleeve downhole tool assembly in an open position or an intermediate position.

The single fluid line sliding sleeve downhole tool assembly has a top sub engaging a top connector. The top connector connects to a body. The body can be eccentric, concentric, or other shapes. The body engages a middle connector, which engages a port housing. The port housing can engage a lower connector, which can engage a bottom sub. An annulus port can be disposed in the port housing for communicating fluid between an annulus and tubing.

A sleeve with a production port can be used for axially moving with respect to the body. It is contemplated that through axial movement of the sleeve, the production port disposed in the sleeve can align with the annulus port disposed in the port housing, allowing injection fluid to flow through the aligned ports and into the reservoir.

A first seal assembly can be used to provide a sealing engagement between the sleeve and top connector. A second seal assembly can provide a sealing engagement between the middle connector and the port housing. A third seal assembly can provide a sealing engagement between the port housing and the sleeve.

In an embodiment, a plurality of plugs can be used to provide a sealing engagement between the body and the annulus.

A first piston in communication with a fluid source can be disposed within the body for providing axial movement relative to the body. The first piston moves axially between at least an original position and at least a secondary position. It is contemplated that the first piston can also move axially to one or more intermediate positions.

A second piston can further be in communication with the fluid source and disposed within the body for providing axial movement relative to the body. The second piston moves axially between at least a second piston original position and at least a second piston secondary position. It is contemplated that the second piston can also move axially to one or more intermediate positions. The first piston causes the sleeve to move in a first direction, and the second piston causes the sleeve to move in a second direction.

A choke can be in the body between the first piston and the second piston. The choke is also connected to the fluid source for supplying hydraulic fluid to the pistons as each piston moves from its original position to the secondary position. In an embodiment, a filter can be disposed between the first and second pistons and the fluid source.

The fluid from the fluid source can be a compressible fluid, such as air, nitrogen, argon, helium, or combinations thereof. In the alternative, the fluid can be a non-compressible fluid, such as oil based hydraulic fluid, water based hydraulic fluid, water, sea water, or combinations thereof. One or more additives, such as amine fluid or corrosion inhibitors, can be disposed within the fluid.

At least one logic drum can be linearly disposed between the body and the sleeve for rotating and translating alternatingly between the first piston and the second piston.

In a contemplated embodiment, the single fluid line sliding sleeve downhole tool assembly has an upper logic drum and a lower logic drum. The upper logic drum can be driven by the first pin into the sleeve while the lower logic drum is driven by the second pin into the sleeve. The one or more logic drums can be linearly secured to the sleeve by at least two fasteners, such as snap rings.

The logic drum can include multiple slots, such as J-shaped slots, which engage a first pin secured to a first shaft for engaging the first piston, and a second pin secured to a second shaft for engaging the second piston. The pins are for guiding axial movement of the sleeve and providing translational force on the sleeve. The pins can have a shape, such as cylindrical, rectangular, cubic, conical, or other polygonal shapes. The first pin and the second pin can have different shapes or identical shapes.

A first relocating device can be used to relocate the first piston from the secondary position to the original position. A second relocating device can be used for relocating the second piston from the second piston secondary position to the second piston original position. The first and second relocation devices can be identical devices or different devices. The first relocating device and the second relocating device can include a spring, a nitrogen chamber, fluid from the annulus, fluid from the tubing, or combinations thereof.

The present method includes applying a first pressure from the fluid source simultaneously to the first piston and the second piston enabling the pistons to move the sleeve from the closed position to an open position. In an embodiment, the first pressure can range from 5000 psi to 20,000 psi.

It is contemplated that as the pistons move to their secondary positions, they cause the first and second pins to move within the slots of the one or more logic drums, causing the sleeve to move axially relative to the body.

The application of the first pressure can be done using a hydraulic accumulator or a hydraulic pump. In an embodiment, the means for actuating the pistons can include one or more springs, a nitrogen chamber, or a secondary control line connected to the fluid source.

The means for actuating the pistons can be located on the single fluid line sliding sleeve downhole tool assembly. It is also contemplated that the means for simultaneously actuating the pistons can be located at the surface of a well, or elsewhere remote from or proximate to the tool assembly.

In a contemplated embodiment, the single line single fluid line sliding sleeve downhole tool assembly can be adapted for use on subsea wells. The means for simultaneously actuating the pistons can be located on a drilling platform, on a floating platform, a fixed leg platform, drill-ship, a semi-submersible, or a similar vessel used in water.

As the sleeve moves axially, the production port disposed in the sleeve aligns with the annulus port disposed in the port housing. The present method then includes allowing injection fluid to move into tubing, through the production port, into the annulus, and into a reservoir.

The injection fluid can be a compressible fluid or a non-compressible fluid and can include sea water, water produced from the well, a hydrocarbon, carbon dioxide, nitrogen, and combinations thereof.

The present embodiment can also include venting fluid to the annulus from the body, to the tubing, or the surface, using a relief valve, such as a check valve. The relief valve can be disposed within the body of the single fluid line sliding sleeve downhole tool assembly. Relieving pressure using a valve disposed between the body and the tubing is also contemplated, which increases the ease and efficiency of performing maintenance.

It is contemplated that the well can be connected to a hydrocarbon bearing subterranean reservoir and the single fluid line sliding sleeve downhole tool assembly can be part of a production tubing string for producing hydrocarbons from the reservoir through the single fluid line sliding sleeve downhole tool assembly and into an inner portion of the production tubing string.

The present embodiment can include the application of a second pressure from the fluid source to the pistons, enabling the first piston and the second piston to move the sleeve from the open position to the closed position.

In an alternative embodiment of the present method for injecting fluid into an oil, natural gas, or water reservoir, at least two single fluid line sliding sleeve downhole tool assemblies can be provided into a well.

A first pressure can be applied to the first piston and the second piston of each of the multiple single fluid line sliding sleeve downhole tool assemblies, enabling the pistons of one single fluid line sliding sleeve downhole tool assembly to move the sleeve from a closed position to an open position, while maintaining the sleeve of one or more other single fluid line sliding sleeve downhole tool assemblies in a closed position.

It is contemplated that the arrangement of slots in the one or more logic drums of the tool assemblies can allow the first and second pistons of multiple single fluid line sliding sleeve downhole tool assemblies to stroke, engaging the first and second pins of each tool assembly, while permitting the sleeve of only one tool assembly to move axially to align the annulus port with the production port. While the pistons within each of the multiple single fluid line sliding sleeve downhole tool assemblies are moved by the first pressure, the arrangement of slots within the logic drums of each tool assembly permits only one tool assembly sleeve to be in an open position at any time.

It is contemplated that from two to twenty-five or more single fluid line sliding sleeve downhole tool assemblies can be provided sequentially in the well and be independently operable. The single fluid line sliding sleeve downhole tool assemblies can be connected in series, forming groups that can then be connected in parallel to a unitary fluid source.

In a contemplated embodiment, a second pressure can be applied from the fluid source simultaneously to each of the single fluid line sliding sleeve downhole tool assemblies, enabling the sleeve of one of the tool assemblies to move from the open position to the closed position. It is further contemplated that the second pressure can enable the sleeve of at least one other tool assembly to simultaneously move from the closed position to the open position. It is also contemplated that the second pressure can enable the sleeve of a tool assembly to move from the open position to the closed position while maintaining the sleeves of all other tool assemblies in the closed position.

In another alternative embodiment of the present method for injecting fluid into an oil, natural gas, or water reservoir, it is contemplated that at least three serially and operationally connected single fluid line sliding sleeve downhole tool assemblies can be provided into a well.

A first of the operationally connected pluralities can be operated independently of at least one of the other operationally connected pluralities. For example, a reservoir could be divided into multiple zones, wherein all individual tool assemblies of one plurality of operationally connected single fluid line sliding sleeve downhole tool assemblies within a single zone could be simultaneously opened, while the operationally connected pluralities in other zones could be moved from an open position to a closed position or maintained in a closed position, such that only the tool assemblies within one reservoir zone are in an open position at any time.

The present embodiments also relate to a method for producing a wellbore fluid from an oil, natural gas, or water reservoir.

This embodiment of the present method includes providing at least one single fluid line sliding sleeve downhole tool assembly into a well. The single fluid line sliding sleeve downhole tool assembly can be in a closed position, however it is contemplated that a tool assembly can also be provided in an open position or an intermediate position.

A first pressure from the fluid source is applied to the first piston and the second piston of the single fluid line sliding sleeve downhole tool assembly, enabling the pistons to move the sleeve from the closed position to an open position, as described previously.

Reservoir fluid is then allowed to move from the reservoir into the annulus, then through the aligned ports, into a production flow line. It is also contemplated that reservoir fluid can be flowed into a tank or vehicle adapted for containing and transporting hydrocarbons, a manufacturing facility, a pipeline, or other similar containers or transport means.

This embodiment of the present method can also include venting fluid to the annulus, to the tubing, or to the surface from the body using a relief valve.

In an embodiment, the present method can further include applying a second pressure from the fluid source simultaneously to the pistons, enabling the pistons to move the sleeve from the open position to the closed position.

In an alternative embodiment for producing wellbore fluid from an oil, natural gas, or water reservoir, at least two single fluid line sliding sleeve downhole tool assemblies can be provided into a well.

A first pressure can be applied to the pistons of each of the one or more single fluid line sliding sleeve downhole tool assemblies, causing the sleeve of a single tool assembly to move from the closed position to the open position while maintaining the sleeves of any other tool assembles in a closed position.

Reservoir fluid can then be allowed to enter through the aligned ports into a production flow line, as described previously.

A second pressure can be applied to the pistons of each single fluid line sliding sleeve downhole tool assembly to move at least one sleeve from the open position to the closed position. It is contemplated that the second pressure can simultaneously cause the movement of a second sleeve from the closed position to the open position. In an alternative embodiment for producing wellbore fluid from an oil, natural gas, or water reservoir, it is contemplated that at least three serially and operationally connected single fluid line sliding sleeve downhole tool assemblies can be provided into a well.

The embodiments of the invention can be best understood with reference to the figures.

Figure 10:
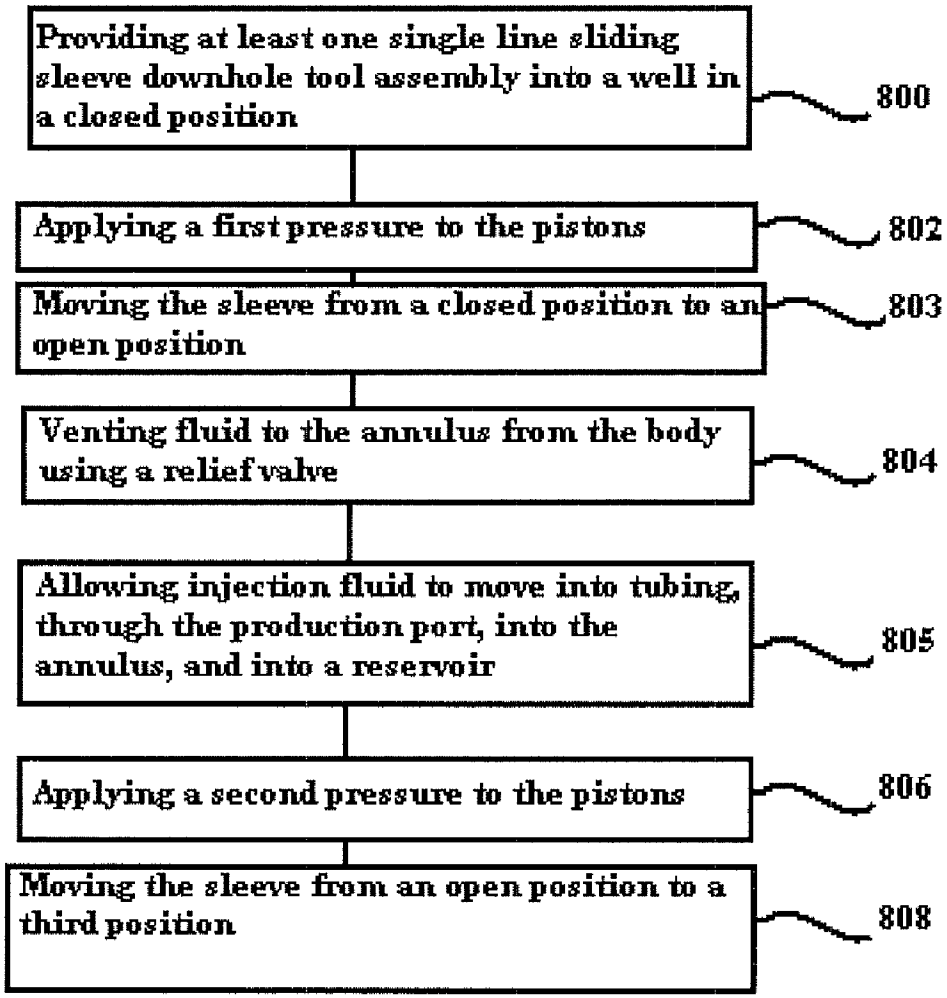
FIG. 10 is a flowchart depicting an embodiment of the present method relating to injection of a fluid into a well using a single tool assembly.

Referring now to FIG. 10, a flowchart depicting an embodiment of the present method relating to injecting fluid into a well is depicted.

The depicted embodiment includes providing at least one single fluid line sliding sleeve downhole tool assembly into a well in a closed position (800). Installation of the sliding sleeve downhole tool assembly can be performed during the installation of tubing.

The depicted embodiment then includes applying a first pressure to the pistons (802) of the single fluid line sliding sleeve downhole tool assembly. The application of the first pressure can be done using the fluid source. This causes the pistons to move to their secondary positions, which in turn causes the first and second pins within the single fluid line sliding sleeve downhole tool assembly to move within the slots of the one or more logic drums. This causes the sleeve of the single fluid line sliding sleeve downhole tool assembly to move.

The depicted embodiment then includes moving the sleeve from a closed position to an open position (803). The embodiment further includes venting fluid to the annulus, to the tubing, or to the surface from the body using a relief valve (804). The depicted embodiment additionally includes allowing injection fluid to move into the tubing, through the production port, into the annulus, and into a reservoir (805).

The depicted embodiment then includes applying a second pressure to the pistons (806), which causes the sleeve to again move. The depicted embodiment concludes by moving the sleeve from an open position to a third position (808). It is contemplated that the third position can be the original closed position, however it is also contemplated that any number of intermediate positions allowing for varying quantities of fluid flow could also be used.

Figure 11:
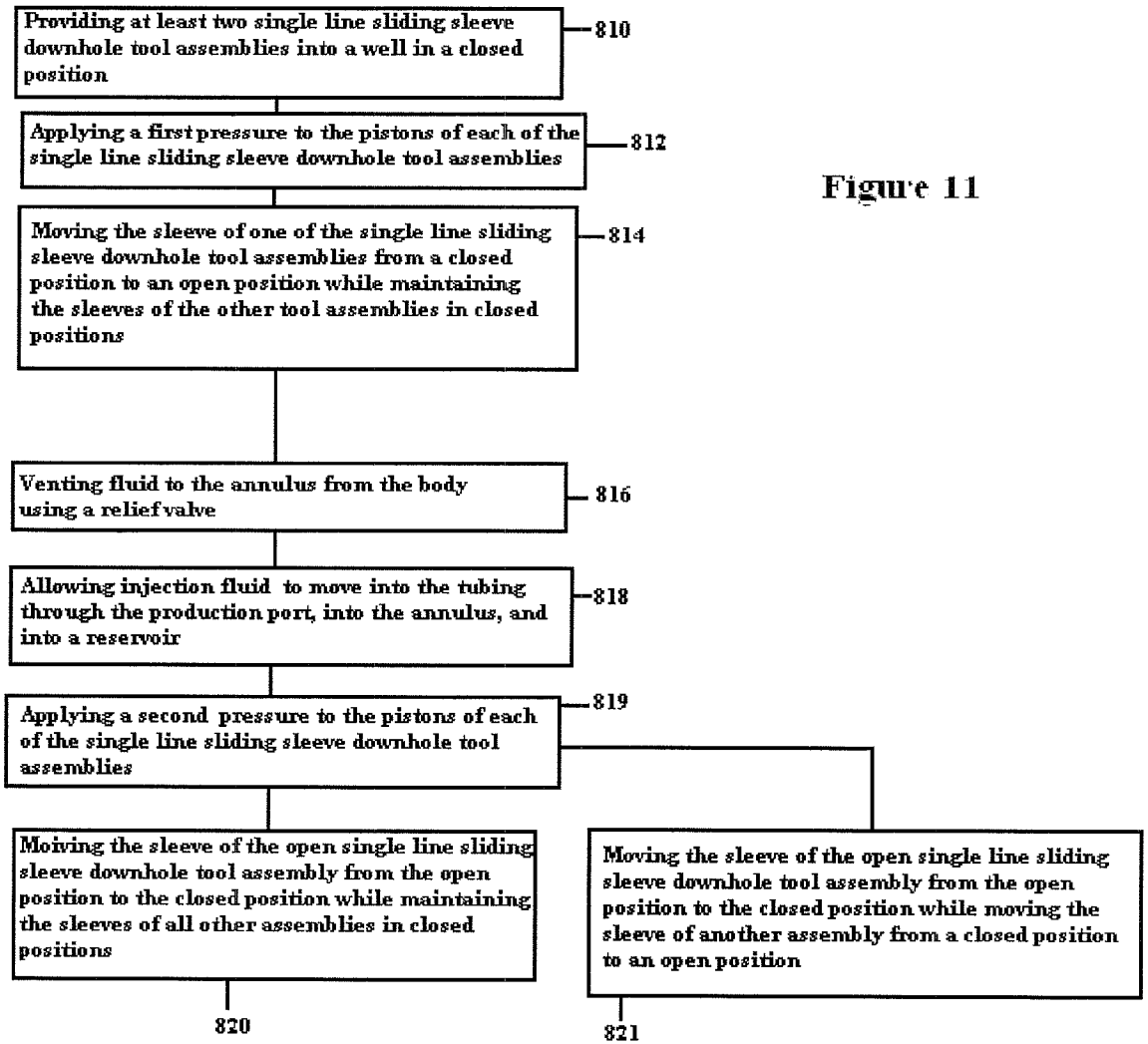
FIG. 11 is a flowchart depicting an embodiment of the present method relating to injection of a fluid into a well using multiple tool assemblies.

Referring now to FIG. 11, a flowchart depicting a second embodiment of the present method relating to injecting fluid into a well is shown.

This depicted embodiment includes providing at least two single fluid line sliding sleeve downhole tool assemblies into a well in a closed position (810). It is contemplated that any number of single fluid line sliding sleeve downhole tool assemblies could be provided. The depicted embodiment then includes applying a first pressure to the pistons of each of the single fluid line sliding sleeve downhole tool assemblies (812). This causes the sleeve of one of the tool assemblies to move from the closed position to the open position, while the sleeves of the other tool assemblies are maintained in the closed position.

The depicted embodiment further includes moving the sleeve of one of the single fluid line sliding sleeve downhole assemblies from a closed position to an open position while maintaining the sleeves of the other tool assemblies in closed positions (814). The embodiment further includes venting fluid to the annulus, to the tubing, or to the surface from the body using a relief valve (816).

The depicted embodiment additionally includes allowing injection fluid to move into the tubing, through the production port, into the annulus, and into a reservoir (818).

The depicted embodiment then includes applying a second pressure to the pistons of each of the single fluid line sliding sleeve downhole tool assemblies (819), which causes one or more of the sleeves to move.

The depicted embodiment can conclude by moving the sleeve of the open single fluid line sliding sleeve downhole tool assembly from the open position to the closed position while maintaining the sleeves of all other assemblies in a closed position (820).

Alternatively, the depicted embodiment can conclude by moving the sleeve of the open single fluid line sliding sleeve downhole tool assembly from the open position to the closed position while moving the sleeve of another assembly from a closed position to an open position (821).

Figure 12:
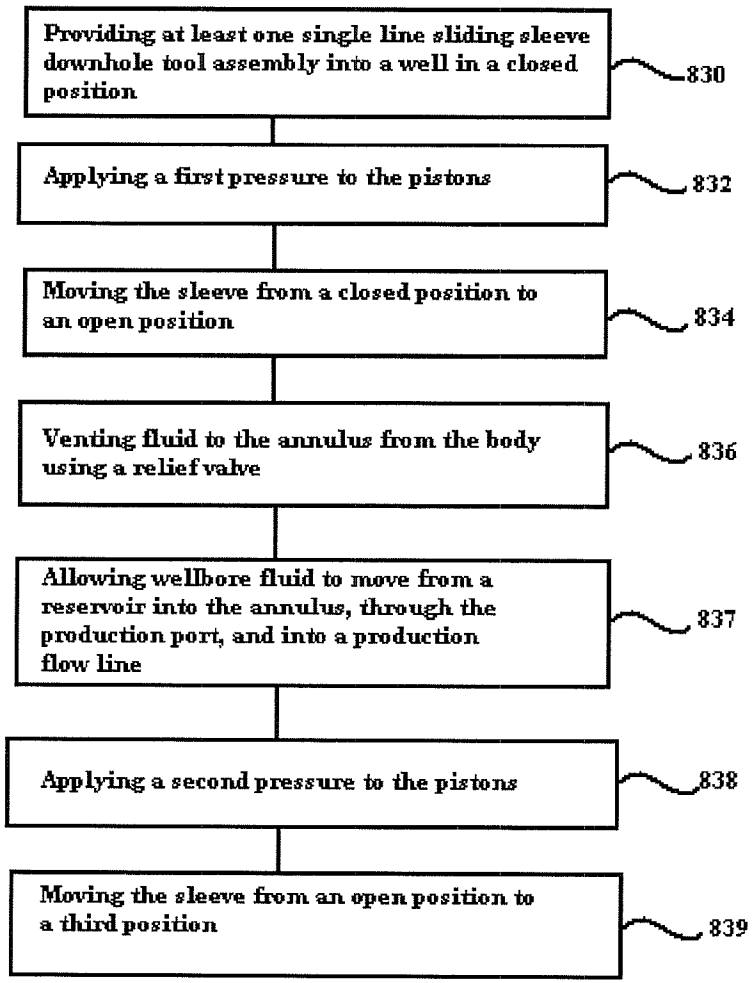
FIG. 12 is a flowchart depicting an embodiment of the present method relating to production of a fluid from a well using a single tool assembly.

Referring now to FIG. 12, a flowchart depicting a third embodiment of the present method relating to producing fluid from a well is shown.

The depicted embodiment includes providing at least one single fluid line sliding sleeve downhole tool assembly into a well in a closed position (830), then applying a first pressure to the pistons (832) of the single fluid line sliding sleeve downhole tool assembly. This causes the sleeve of the single fluid line sliding sleeve downhole tool assembly to move.

The depicted embodiment then includes moving the sleeve from a closed position to an open position (834). The embodiment further includes venting fluid to the annulus, to the tubing, or to the surface from the body using a relief valve (836).

The depicted embodiment then includes allowing wellbore fluid to move from a reservoir into the annulus, through the production port, and into a production flow line (837). It is contemplated that the well tubing is part of or is in communication with a production flow line.

The embodiment then includes applying a second pressure to the pistons (838), which causes the sleeve of the single fluid line sliding sleeve downhole tool assembly to move. The depicted embodiment then concludes with moving the sleeve from an open position to a third position (839). It is contemplated that the third position can be the original closed position, or any number of intermediate positions that allow for any intermediate quantity of injection fluid to enter the reservoir.

Figure 13:
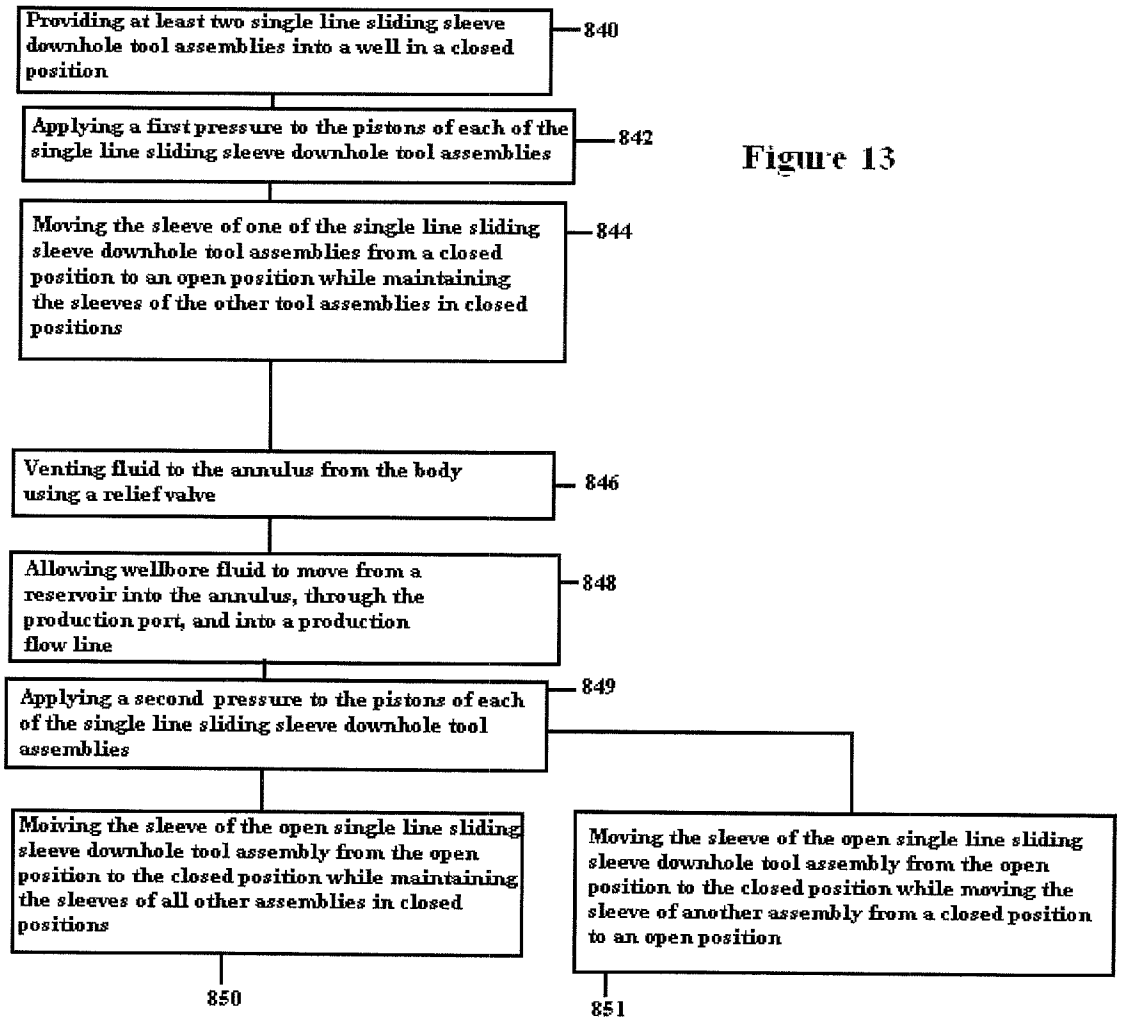
FIG. 13 is a flowchart depicting an embodiment of the present method relating to production of a fluid from a well using multiple single tool assemblies.

Referring now to FIG. 13, a flowchart depicting a fourth embodiment of the present method relating to producing fluid from a well is shown.

This depicted embodiment includes providing at least two single fluid line sliding sleeve downhole tool assemblies into a well in a closed position (840). The depicted embodiment then includes applying a first pressure to the pistons of each of the single fluid line sliding sleeve downhole tool assemblies (842). This causes the sleeve of one of the tool assemblies to move from the closed position to the open position, while the sleeves of the other tool assemblies are maintained in the closed position.

The depicted embodiment further includes moving the sleeve of one of the single fluid line sliding sleeve downhole assemblies from a closed position to an open position while maintaining the sleeves of the other tool assemblies in closed positions (844). The embodiment further includes venting fluid to the annulus, to the tubing, or to the surface from the body using a relief valve (846).

The depicted embodiment then includes allowing wellbore fluid to move from a reservoir into the annulus, through the production port, and into a production flow line (848). The embodiment further includes applying a second pressure to the pistons of each of the single fluid line sliding sleeve hydraulic tool assemblies (849), which causes one or more sleeves of the tool assemblies to move. The depicted embodiment can conclude by moving the sleeve of the open single fluid line sliding sleeve downhole tool assembly from the open position to the closed position while maintaining the sleeves of all other assemblies in a closed position (850).

Alternatively, the depicted embodiment can conclude by moving the sleeve of the open single fluid line sliding sleeve downhole tool assembly from the open position to the closed position while moving the sleeve of another assembly from a closed position to an open position (851).

Figure 2:
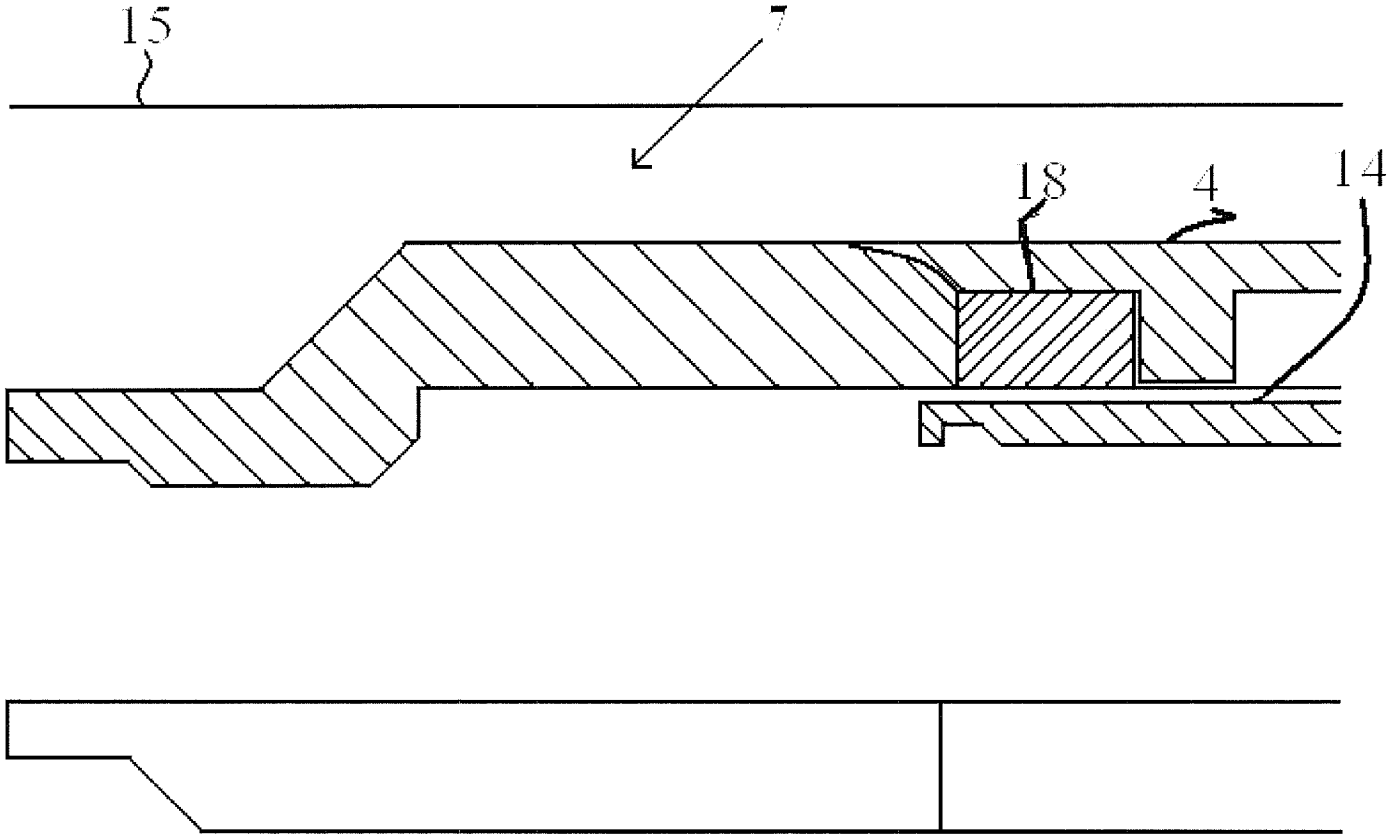
FIG. 2 depicts a cross sectional view of a top section of an embodiment of the a single fluid line sliding sleeve downhole tool assembly.

Referring now to FIG. 1 a cross sectional view of an embodiment of a central section of the present single fluid line sliding sleeve downhole tool assembly is depicted. A top connector 4 is depicted in communication with a body 6. The top connector can be a cylindrical threaded tubular member having a seal surface forming an inner diameter between 2.25 inches and 6.75 inches and an outer diameter between 2.5 and 7 inches. The top connector can made from carbon steel or another nickel alloy. The top connector can be between 1 foot and 4 feet long. In FIG. 2, the top connector 4 is further shown having an inner shoulder 69 creating an inner diameter between 0.25 inch and 0.5 inches in the top connector.

Returning to FIG. 1, the body 6 can be made from carbon steel or a nickel alloy steel. The body has an overall length ranging from one foot to ten feet. The body is generally tubular and cylindrical, but can be another shape than can run into a well, such as an oblong or elliptical shape. The body is contemplated to be mostly metal and have a tensile strength equal to or greater than the tubing in the body.

An upper logic drum 23*a* and a lower logic drum 23*b* are disposed between the body 6 and a sleeve 14 for rotating and translating alternatingly between a first piston 26 and a second piston 28.

The first piston 26 is disposed in the body 6 and connected to a fluid source 30, such as a fluid reservoir, a pressurized tank, a hydraulic tank, or a similar fluid containment device. The communication is through a single fluid line 71. The first piston 26 can be made from steel, another elastomeric material or a nonelastomeric material which enables the piston to slide in the chamber. The pistons have an outer diameter ranging from 0.25 inches to 1.5 inches and an overall length ranging from 0.25 inches to 2 inches. The first piston 26 is connected to a first shaft 27*a*. The first shaft 27*a* can have be made from steel or another material. The shaft can have a cylindrical shape or another polygonal shape.

The first shaft 27*a* is connected to a first pin 25*a*. The first pin 25*a* can have a cylindrical shape, a conical shape, a cubic shape, a rectangular shape, or a substantially similar shape. The first pin can range from 0.25 inches to 2 inches in length and have a diameter between ranging from 0.125 inches to 1.5 inches. The pin can be solid or hollow.

A second piston 28 is disposed within the body 6 opposite the first piston 26. The second piston 28 is also connected to the fluid source 30. The fluid communication is the single fluid line 71.

The second piston 28 is secured to a second shaft 27*b*, which can be substantially similar to the first shaft 27*a*. The second shaft 27*a* is secured to second pin 25*b*, which can be substantially similar to the first pin 25*a*. The second pin 25*b* can also have a different shape than the first pin 25*a*. The first pin 25*a* engages the upper logic drum 23*a*, and the second pin 25*b* engages the lower logic drum 23*b*.

A first plug 48*a* separates the body 6 from an adjacent annulus 7. A second plug 48*b* on the opposite side of the body 6 also separates the body 6 from the annulus 7. The first plug 48*a* and the second plug 48*b* can be steel or another nonelastomeric material that prevents fluid from leaking out of the body or into the body, insuring the environmental compliance of the tool assembly.

First plug 48*a* and second plug 48*b* provide a sealing engagement between the body 6 and the annulus 7. FIG. 1 also depicts a third plug 48*c*, separating the body 6 from the annulus 7, which can be substantially similar to first plug 48*a* and second plug 48*b*. It is also contemplated that first plug 48*a*, second plug 48*b*, and third plug 48*c* can be different types of plugs.

A valve 42 is depicted disposed within the body 6 between the body 6 and the annulus 7. In another embodiment the valve 42 can be between the body 6 and the tubing 15, or the body 6 and the surface. The valve 42 can be operated to release pressure from within the body 6 created through the movement of first piston 26 and second piston 28. The valve 42 can be a check valve, or a check valve with a spring applying an additional force, such as part PRRA 2812080L from the Lee Company of Westbrook, Conn.

A choke 44 is depicted disposed in the body 6 between the first piston 26 and the second piston 28. The choke 44 in one embodiment is a choke, such as the Visco Jet™ choke available also from the Lee Company as part number VHCA 1845112H. The choke 44 could also be pneumatic, or a combination of hydraulic and pneumatic chokes connected in series, wherein the chokes are connected to their respective fluid sources for supplying fluid. In an embodiment, fluid can be supplied from one fluid source to the first piston 26 and the second piston 28 as the pistons move.

FIG. 1 also depicts a first relocating device 46*a* disposed on the first shaft 27*a* for returning the first piston 26 from its secondary position to its original position. A second relocating device 46*b* is depicted disposed on the second shaft 27*b* for returning the second piston 26 from its secondary position to its original position.

The first relocating device 46*a* and the second relocating device 46*b* are depicted as springs, and can be coiled springs, wave springs, such as spring part number CO75-H6 from Smalley of Chicago, Ill., or a nitrogen chamber, such as a nitrogen chamber made by the Petroquip Energy Services Company of Houston, Tex.

A fluid source 30 is in fluid communication with the first piston 26 and the second piston 28. A filter 3 is disposed between the fluid source and the first piston.

FIG. 2 depicts a cross sectional view of an embodiment of a top section of the present single line single line sleeve downhole tool assembly.

A top sub 2, which can be made of carbon steel, or a nickel alloy, and can be made by PetroQuip Energy Services Company of Houston Tex., is depicted engaging the top connector 4.

A first seal assembly 18 is depicted providing a sealing engagement between the sleeve 14 and the top connector 4. The first seal assembly 18 can be any non elastomeric material.

Figure 3:
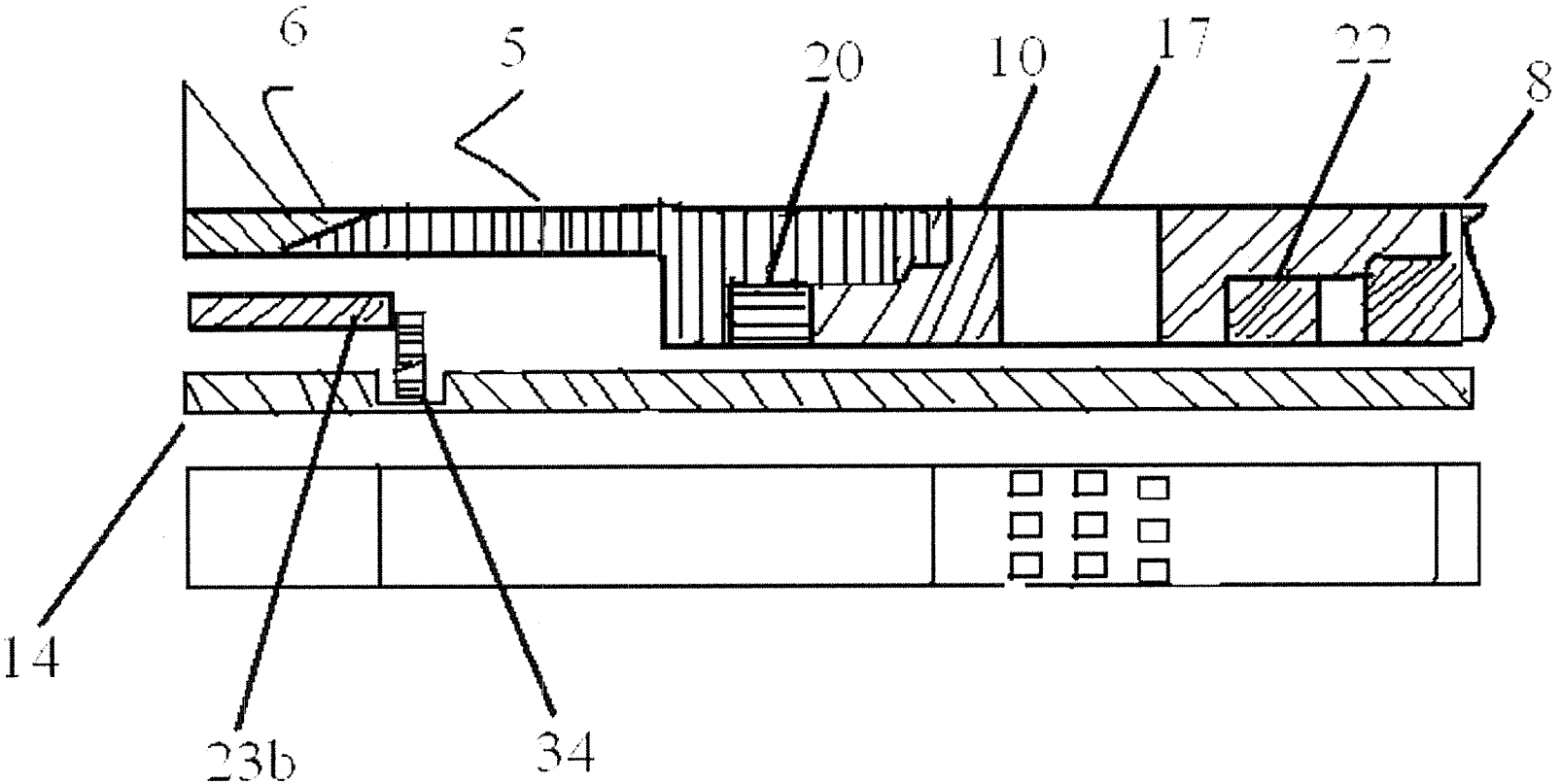
FIG. 3 depicts a cross sectional view of a mid-lower section of an embodiment of a single fluid line sliding sleeve downhole tool assembly.

FIG. 3 depicts a cross sectional view of an embodiment of a mid-lower section of a single line single line sleeve downhole tool assembly.

A middle connector 5 is between the body 6 and a port housing 10. The middle connector 5 can be made from steel or a nickel alloy. The port housing 10 can also be made from steel or nickel alloy, such as the port housing available from Petroquip Energy Services Company, and can be a tubular member having a length ranging from 12 inches to 24 inches.

The port housing 10 engages a lower connector 8. The lower connector 8 is a tubular member with a threaded engagement on each end. The lower connector 8 does not have an inner shoulder. The overall length of the lower connector 8 can range from 6 inches to 2 feet and can have an inner diameter range from 2.25 inches to 5.75 inches. The lower connector can be made from a carbon steel or a nickel alloy.

An annulus port 17 is disposed within the port housing 10. The annulus port 17 can have an outer diameter ranging from 3 inches to 7 inches, and an inner diameter ranging from 2.25 inches to 5.75 inches.

The annulus port 17 flows fluid, such as hydrocarbons or similar wellbore fluids from the annulus 7 to the production port 16, then to the tubing 15 and to the production line 90.

FIG. 3 depicts a second seal assembly 20, which provides a sealing engagement between a middle connector 5 and the sleeve 14.

A third seal assembly 22 is depicted for providing a sealing engagement between the port housing 10 and the sleeve 14. The second seal assembly 20 and the third seal assembly 22 can be substantially similar to the first seal assembly 18, depicted in FIG. 2, and can be best understood with reference to FIG. 8.

In another embodiment the second seal assembly 20 and the third seal assembly 22 can be different types of seals. For example, a second seal assembly can be made from Teflon™, available from DuPont of Wilmingdton, Del., and a third seal assembly can be made from PEEK™ (polyester ester ketone), also made by Dupont.

In another embodiment, the second seal assembly can be made from a blend of a 95% PEEK and 5% Viton™ from Dupont.

The lower logic drum 23*b* is depicted in an operative position, secured to the sleeve 14 with a second fastener 34. The first fastener 32, depicted in FIG. 1, and the second fastener 34, shown in FIG. 3, work in concert to connect the upper logic drum 23*a* and the lower logic 23*b* to the sleeve 14. The first fastener 32 and the second fastener 34 can be a snap ring that captures the upper and lower logic drums 23*a* and 23*b* relative to the sleeve 14. The fasteners can be snap rings from Smalley, shear pins, shear screws, locking dogs, or combinations thereof.

Figure 4:
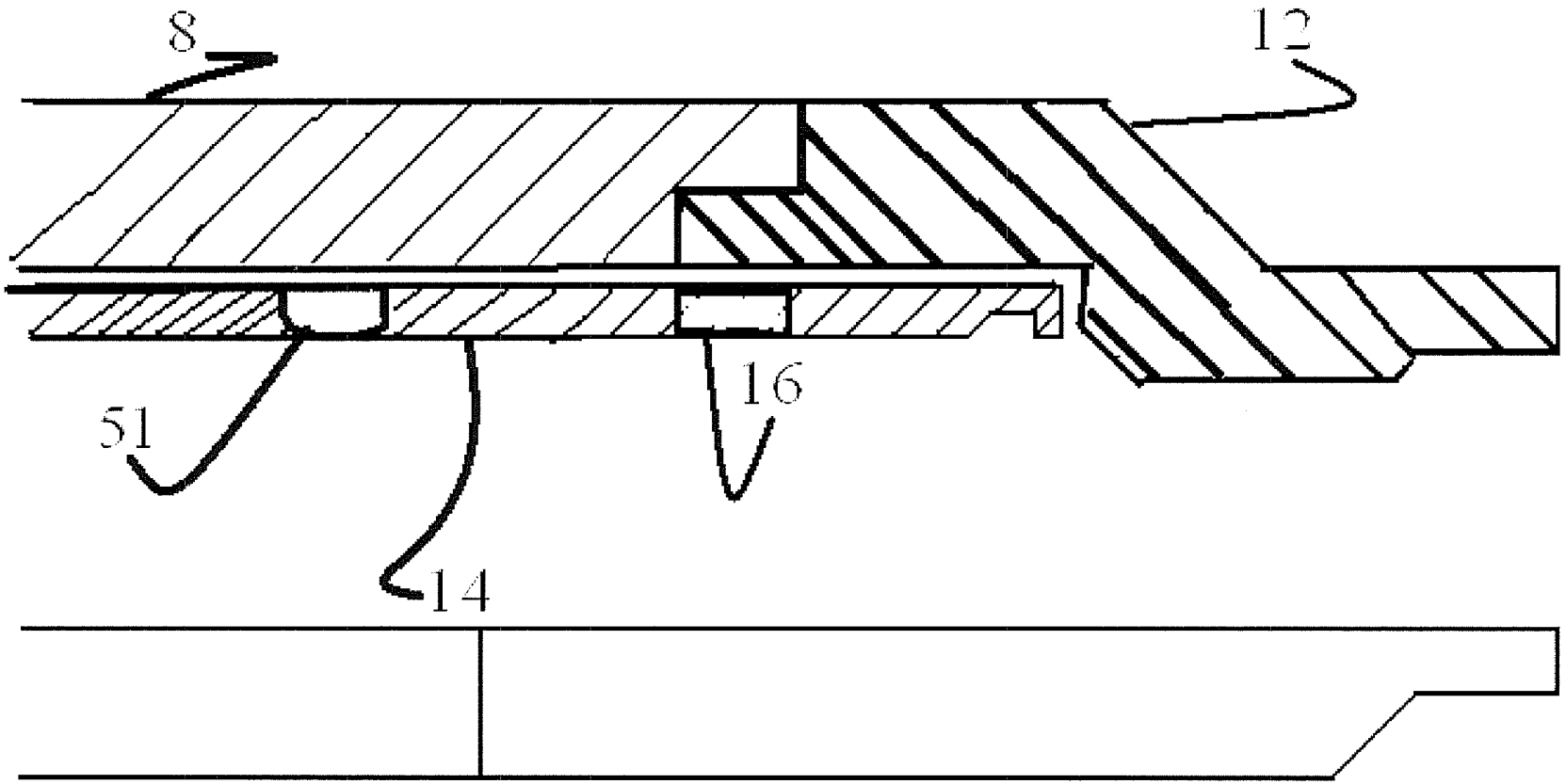
FIG. 4 depicts a cross sectional view of a bottom section of an embodiment of a single fluid line sliding sleeve downhole tool assembly.

Referring now to FIG. 4, a cross sectional view of an embodiment of a bottom section of the present single line sliding sleeve downhole tool assembly is depicted. The sleeve 14 is depicted in an operative arrangement with a production port 16 for axially moving with respect to lower connector 8. Production port 16 allows a flow area equal to or greater than the flow area of the tubing 15.

The production port 51, which can have a diameter ranging from 0.025 inches to 3 inches is depicted. When the single line sliding sleeve assembly is in a closed position the equalizing port 51 and the production port 16 are isolated from the annulus port 17, and when in the open position the annulus port 17 and the production port 51 are aligned so that the annulus 7 and the sleeve 14 are in communication.

Figure 5A:
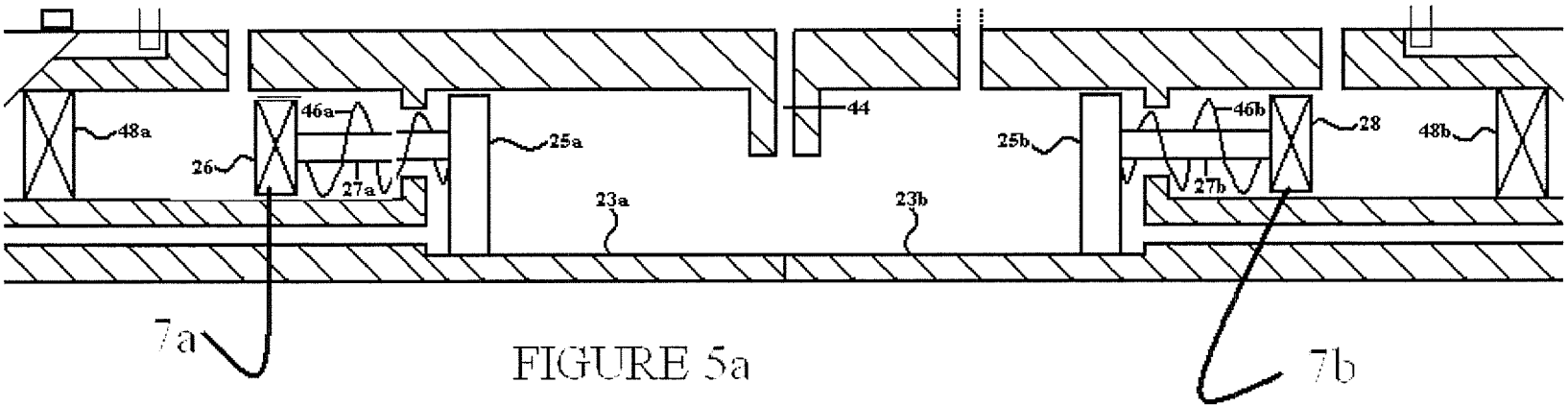
FIG. 5A depicts a cross sectional view of an embodiment of a single fluid line sliding sleeve downhole tool assembly showing a piston in its original position.

Referring now to FIG. 5*a*, the first piston 26 is depicted within the body 6 in its original position. The first relocating device 46*a* is depicted extended. The second piston 28 is further depicted in its original position with second relocating device 46*b* extended.

Figure 5B:
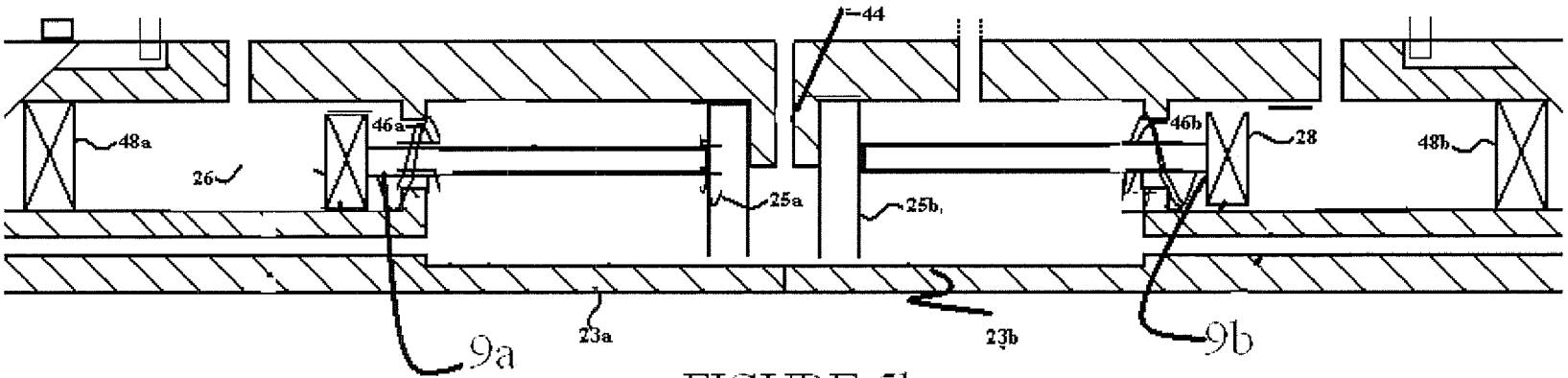
FIG. 5B depicts a cross sectional view of an embodiment of a single fluid line sliding sleeve downhole tool assembly showing a piston in its secondary position.

FIG. 5*b* depicts the first piston 26 after the first piston 26 has moved axially within the body 6, achieving its secondary position. The first relocation device 46*a* is depicted compressed. The second piston 28 is further depicted its secondary position 9*b*, with second relocating device 46*b* compressed.

Figure 6:
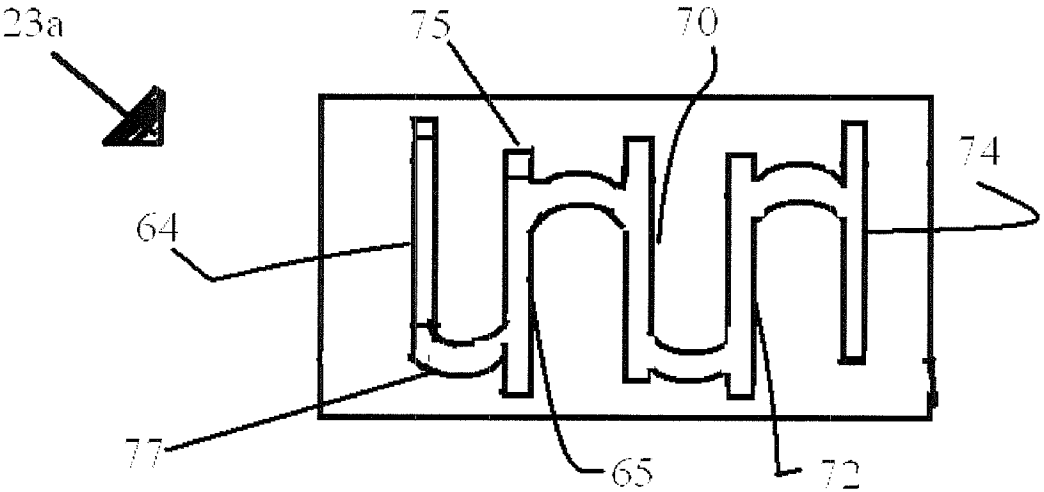
FIG. 6 is an unfolded view of an embodiment of the logic drum.
Figure 7:
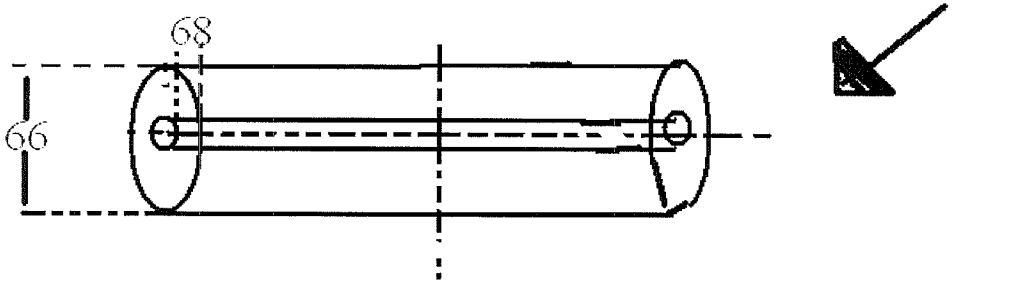
FIG. 7 is an isometric view of the embodiment of the logic drum.

An embodiment of the upper logic drum 23*a* is depicted in a unfolded view in FIG. 6 and an isometric view in FIG. 7. The upper logic drum 23*a* can have an overall diameter 66 ranging from 2.8 inches to 5.5 inches. The upper logic drum 23*a* can have a wall thickness 68 ranging from 0.125 inches to 0.5 inches. The upper logic drum 23*a* has at least two positioning slots.

In FIG. 6, a plurality of positioning slots 64, 65, 70, 72, 74 are disposed within the wall of the upper logic drum 23*a*. The positioning slots 64, 65, 70, 72, 74 can range from 25% to 75% of the length of the upper logic drum 23*a*. The upper logic drum 23*a* can have a length ranging from 8 inches to 60 inches. The positioning slots 64, 65, 70, 72, 74 can have a J shape. In an embodiment, the positioning slots can have a landing slot 75 and a rotation slot 77. The positioning slots 64, 65, 70, 72, 74 engage the pins within the landing slots 75 and remove torque. The positioning slots 64, 65, 70, 72, 74 can vary in length. The pins engage these slots for positioning the sleeve 14.

Figure 8:
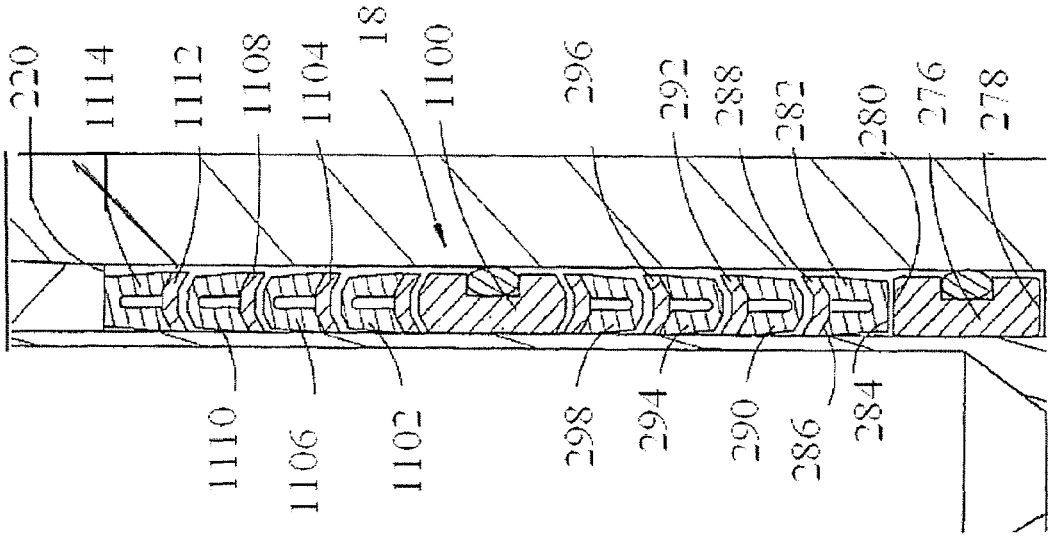
FIG. 8 is a cross sectional view of a seal assembly.

Referring now to FIG. 8, an exemplary seal assembly 18 is depicted. The seal assembly 18 comprises an equalizing seal means 276, wherein the equalizing seal means 276 can be constructed of filled PEEK, which is commercially available from Green Tweed under the name Arlon™. The PEEK has a tensile strength greater than 25,000 psi at 70 degrees F., and 13,000 psi at 350 degrees F. All seal means of the seal assembly 18 may be constructed of any equivalent type of material, such as Teflon, made by the DuPont Corporation.

An end 278 of the equalizing seal means 276 abuts the radial shoulder 222 and the opposite end 280 abuts the header seal ring means 282. The header seal means 282 can be constructed of filled PEEK. The header seal means 282 has a first end 284 and a second angled end 286. A non-extrusion ring 288 is included, which can be constructed of filled PEEK. The non-extrusion ring 288 comprises a concave shape and can prevent the extrusion and bulging of the ring members on either side.

The seal assembly 18 can further comprise a first seal ring means 290. The seal ring means 290 can constructed of filled PEEK. A second non-extrusion ring 292 can be provided, which in turn leads to a second seal ring means 294. The seal assembly 18 can also include a follower seal ring 1100, which can be constructed of filled PEEK. The follower seal ring 1100 has a first and second curved surface. A fourth seal ring means 1102 can be included wherein one end abuts the follower seal ring 1100 and the other end abuts a non-extrusion ring 1104.

A fifth seal ring means 1106 is provided that will in turn abut the non-extrusion ring 1108. The non-extrusion ring 1108 will then abut the sixth seal ring means 110 that in turn will abut the non-extrusion ring 1112. The non-extrusion ring 1112 will abut the header seal ring 1114. The header seal ring 1114 will have an angled end abutting the back side of the non-extrusion ring 1108, and a second radially flat end that will abut the radial end 220.

Figure 9A:
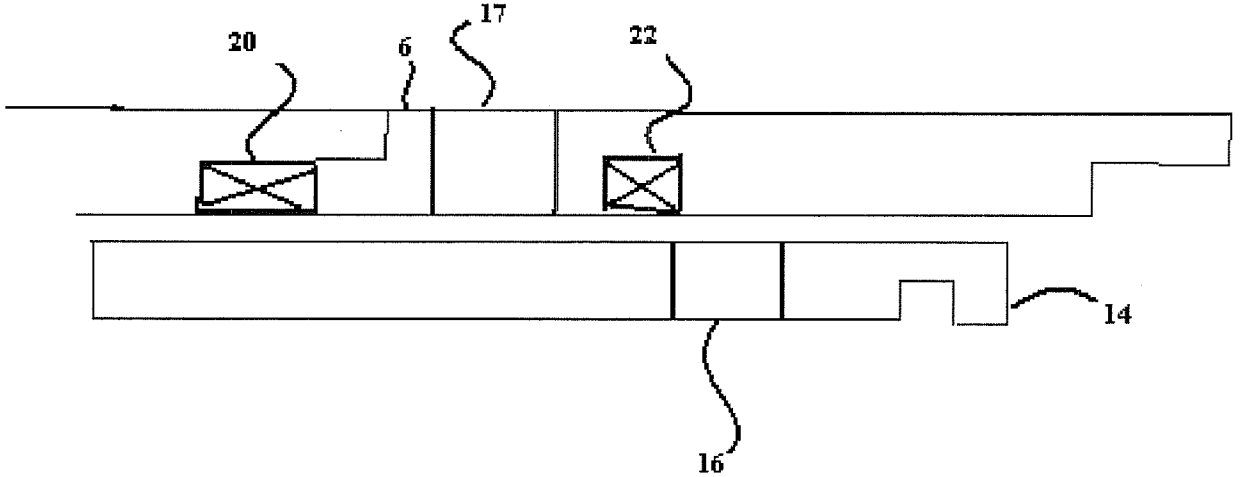
FIG. 9A is a cross sectional view of the sleeve of a single fluid line sliding sleeve downhole tool assembly in a closed position.

Referring now to FIG. 9A, the sleeve of a single fluid line sliding sleeve downhole tool assembly is depicted in a closed position.

Sleeve (14) is depicted having a production port (16). Body (6) is depicted having annulus port (17), second seal assembly (20), and third seal assembly (22).

FIG. 9A depicts production port (16) disposed beneath third seal assembly (22), misaligned from annulus port (17), thereby preventing fluid from flowing through production port (16).

Figure 9B:
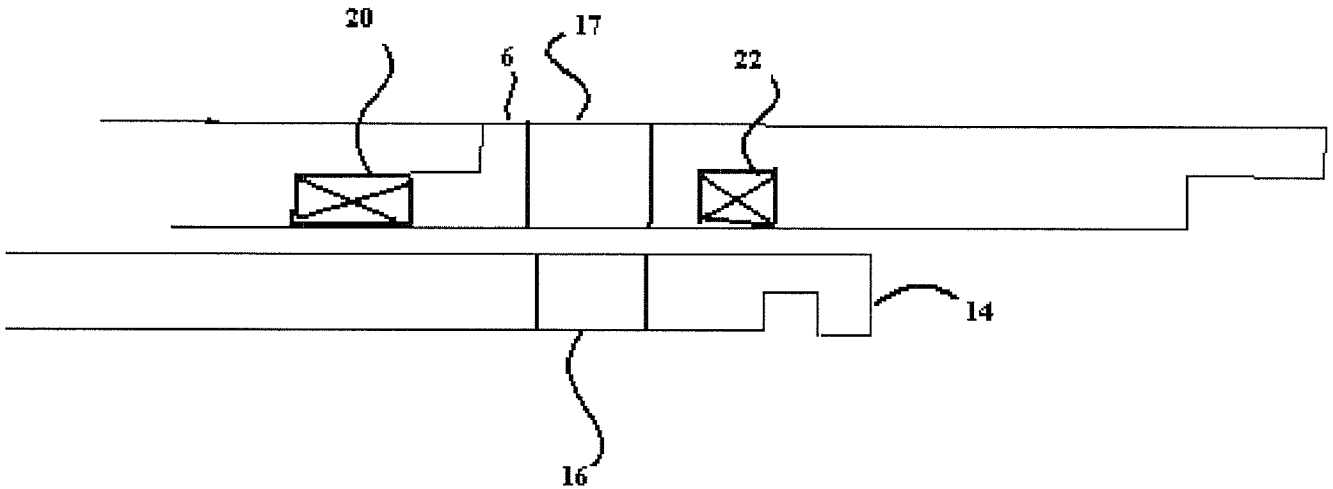
FIG. 9B is a cross sectional view of the sleeve of a single fluid line sliding sleeve downhole tool assembly in an open position.

FIG. 9B depicts a cross sectional view of the single fluid line sliding sleeve downhole tool assembly depicted in FIG. 7*a* after sleeve (14) has moved axially into an open position.

Production port (16) of sleeve (14) is depicted in alignment with annulus port (17) of body (6), allowing fluid to flow through the aligned ports.

Figure 14:
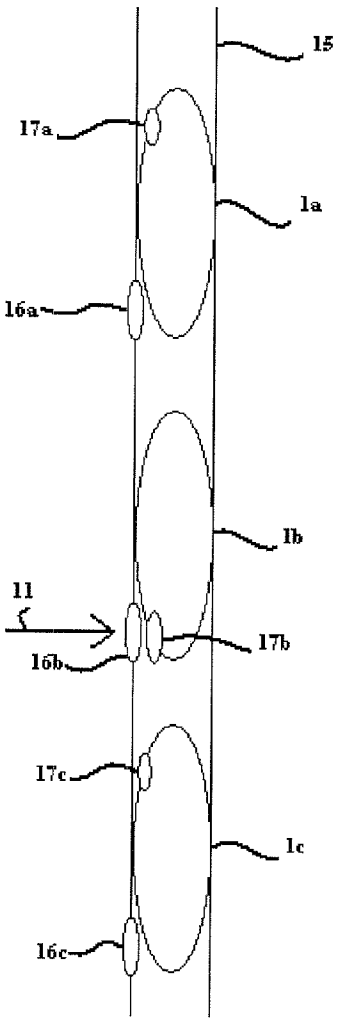
FIG. 14 is a cross sectional view of tubing within a well with multiple sliding sleeve tool assemblies installed.

Referring now to FIG. 14, a depiction of a tubular string with three installed single fluid line sliding sleeve downhole tool assemblies is shown.

Tubing (15) is depicted having first single fluid line sliding sleeve downhole tool assembly (1*a*) disposed above second single fluid line sliding sleeve downhole tool assembly (1*b*). Second single fluid line sliding sleeve downhole tool assembly (1*b*) is disposed above third single fluid line sliding sleeve downhole tool assembly (1*c*).

First single fluid line sliding sleeve downhole tool assembly (1*a*) has first annulus port (17*a*) and first production port (16*a*). Second single fluid line sliding sleeve downhole tool assembly (1*a*) has second annulus port (17*b*) and second production port (16*b*). Third single fluid line sliding sleeve downhole tool assembly (1*c*) has third annulus port (I 7*c*) and third production port (16*c*).

FIG. 14 depicts second annulus port (17*b*) and second production port (16*b*) in alignment, allowing hydrocarbons (11) to flow thorough second annulus port (17*b*) and second production port (16*b*) into tubing (15). While second annulus port (17*b*) and second production port (16*b*) are in alignment, first annulus port (17*a*) and first production port (16*a*) are not in alignment, and third annulus port (17*c*) and third production port (16*c*) are not in alignment. It is contemplated that only one of first single fluid line sliding sleeve downhole tool assembly (1*a*), second single fluid line sliding sleeve downhole tool assembly (1*b*), or third single fluid line sliding sleeve downhole tool assembly (1*c*) is in an open position, having aligned ports, at any time.

Figure 15:
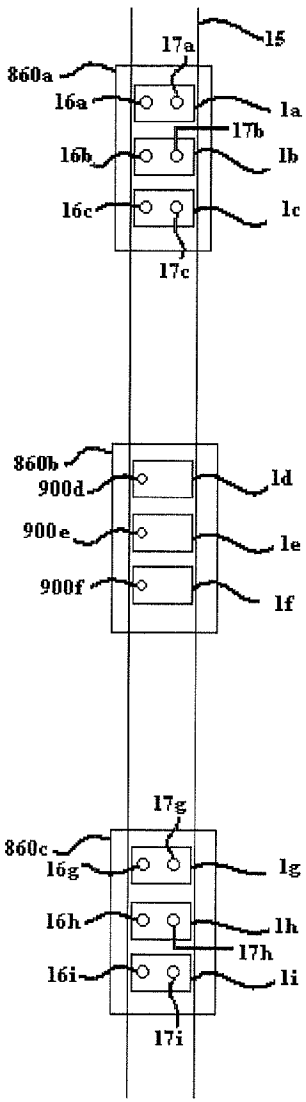
FIG. 15 is a cross sectional view of tubing within a well with multiple operationally connected pluralities of sliding sleeve tool assemblies installed.

Referring now to FIG. 15, a depiction of a tubular string with three serially operationally connected pluralities of three single fluid line sliding sleeve downhole tool assemblies is shown.

Within tubing (15), three optionally connected pluralities of single fluid line sliding sleeve downhole tool assemblies are depicted, first serially operationally connected plurality (860*a*), second serially operationally connected plurality (860*b*), and third serially operationally connected plurality (860*c*). It is contemplated that each plurality of tool assemblies is located within a different zone of a well.

First serially operationally connected plurality (860*a*) includes first tool assembly (1*a*), second tool assembly (1*b*), and third tool assembly (1*c*). Second serially operationally connected plurality (860*b*) includes fourth tool assembly (1*d*), fifth tool assembly (1*e*), and sixth tool assembly (If). Third serially operationally connected plurality (860*c*) includes seventh tool assembly (1*g*), eighth tool assembly (1*h*), and ninth tool assembly (1*i*). It is contemplated that each tool assembly within a plurality is assembled such that all tool assemblies within a single connected plurality will be simultaneously in an open position or a closed position and can simultaneously change positions responsive to pressure from a fluid source.

First tool assembly (1*a*) has first production port (16*a*) and first annulus port (17*a*). Second tool assembly (1*b*) has second production port (16*b*) and second annulus port (17*b*). Third tool assembly (1*c*) has third production port (16*c*) and third annulus port (17*c*).

Seventh tool assembly (1*g*) has seventh production port (16*g*) and seventh annulus port (17*g*). Eighth tool assembly (1*h*) has eighth production port (16*h*) and eighth annulus port (17*h*). Ninth tool assembly (1*i*) has ninth production port (16*i*) and ninth annulus port (17*i*).

First production port (16*a*) and first annulus port (17*a*) are not in alignment. Second production port (16*b*) and second annulus port (17*b*) are also not in alignment. Third production port (16*c*) and third annulus port (17*c*) are not in alignment. Seventh production port (16*g*) and seventh annulus port (17*g*) are not in alignment. Eighth production port (16*h*) and eighth annulus port (17*h*) are also not in alignment. Ninth production port (16*i*) and ninth annulus port (17*i*) are not in alignment.

Thus, FIG. 15 depicts first tool assembly (1*a*), second tool assembly (1*b*), third tool assembly (1*c*), seventh tool assembly (1*g*), eighth tool assembly (1*h*), and ninth tool assembly (1*i*) in a closed position. Each tool assembly within first serially operationally connected plurality (860*a*) and each tool assembly within third serially operationally connected plurality (860*c*) are in a closed position.

Fourth tool assembly (1*d*) is depicted having fourth aligned ports (900*d*). Fifth tool assembly (1*e*) is depicted having aligned ports (900*e*). Sixth tool assembly (if) is depicted having aligned ports (900*f*). Thus, FIG. 15 depicts fourth tool assembly (1*d*), fifth tool assembly (1*e*), and sixth tool assembly (11) in an open position. Each tool assembly within second serially operationally connected plurality (860*b*) is in an open position.

It is contemplated that only one connected plurality of single fluid line sliding sleeve downhole tool assemblies will be in an open position at any given time, thus allowing hydrocarbons to flow through tubing (15) from only one zone of a well.

While these embodiments have been described with emphasis on the embodiments, it should be understood that within the scope of the appended claims, the embodiments might be practiced other than as specifically described herein.

What is claimed is:

1. A method for injecting an injection fluid into an oil, natural gas, or water reservoir, the method comprising:

providing at least one single fluid line sliding sleeve downhole tool assembly into a well in a closed position, wherein the at least one single fluid line sliding sleeve downhole tool assembly comprises:

a top sub engaging a top connector which connects to a body that engages a middle connector which is secured to a port housing, wherein the port housing engages a lower connector and the lower connector engages a bottom sub;

a sleeve with a production port for axially moving with respect to the body;

an annulus port disposed in the port housing for communicating fluid between an annulus and tubing in the sleeve;

a first seal assembly providing a sealing engagement between the sleeve and the top connector;

a second seal assembly providing a sealing engagement between the middle connector and the sleeve;

a third seal assembly providing a sealing engagement between the port housing and the sleeve;

a first piston in communication with a fluid source and wherein the first piston moves axially between at least an original position and at least a secondary position;

a second piston in communication with the fluid source and wherein the second piston moves axially between at least a second piston original position and at least a second piston secondary position; and wherein the first piston moves the sleeve in a first direction and the second piston moves the sleeve in a second direction;

at least one logic drum linearly disposed between the body and the sleeve for rotating and translating alternatingly between the first piston and the second piston;

a means for actuating the first piston and the second piston;

a first relocating device for relocating the first piston from the secondary position to the original position and a second relocating device for relocating the second piston from the second piston secondary position to the second piston original position;

applying a first pressure from the fluid source simultaneously to the first piston and the second piston enabling the first piston and the second piston to move the sleeve from the closed position to an open position; and allowing injection fluid to move into tubing, through the production port, into the annulus, and into a reservoir.

2. The method of claim 1, wherein the injection fluid is a compressible fluid or a non-compressible fluid.

3. The method of claim 2, wherein the injection fluid is a member of the group consisting of: sea water, water produced from the well, a hydrocarbon, carbon dioxide, nitrogen, and combinations thereof.

4. The method of claim 1, wherein the first pressure ranges from 5000 psi to 20,000 psi.

5. The method of claim 1, further comprising venting fluid from the body to the annulus, the surface, the tubing, or combinations thereof using a relief valve.

6. The method of claim 1, wherein the well is connected to a hydrocarbon bearing subterranean reservoir and the single fluid line sliding sleeve downhole tool assembly is part of a production tubing string for producing hydrocarbons from the reservoir through the single fluid line sliding sleeve downhole tool assembly and into an inner portion of the production tubing string.

7. The method of claim 1, further comprising the step of applying a second pressure from the fluid source simultaneously to the first piston and the second piston enabling the first piston and the second piston to move the sleeve from the open position to the closed position.

8. A method for injecting an injection fluid into an oil, natural gas, or water reservoir, the method comprising:

providing at least two single fluid line sliding sleeve downhole tool assemblies into a well in a closed position, wherein each of the at least two single fluid line sliding sleeve downhole tool assemblies comprise:

a top sub engaging a top connector which connects to a body that engages a middle connector which is secured to a port housing, wherein the port housing engages a lower connector and the lower connector engages a bottom sub;

a sleeve with a production port for axially moving with respect to the body;

an annulus port disposed in the port housing for communicating fluid between an annulus and tubing in the sleeve;

a first seal assembly providing a sealing engagement between the sleeve and the top connector;

a second seal assembly providing a sealing engagement between the middle connector and the sleeve;

a third seal assembly providing a sealing engagement between the port housing and the sleeve;

a first piston in communication with a fluid source and wherein the first piston moves axially between at least an original position and at least a secondary position;

a second piston in communication with the fluid source and wherein the second piston moves axially between at least a second piston original position and at least a second piston secondary position; and wherein the first piston moves the sleeve in a first direction and the second piston moves the sleeve in a second direction;

at least one logic drum linearly disposed between the body and the sleeve for rotating and translating alternatingly between the first piston and the second piston;

a means for actuating the first piston and the second piston;

a first relocating device for relocating the first piston from the secondary position to the original position and a second relocating device for relocating the second piston from the second piston secondary position to the second piston original position;

applying a first pressure from the fluid source simultaneously to the first piston and the second piston of each at least two single fluid line sliding sleeve downhole tool assemblies enabling the first piston and the second piston of a first single fluid line sliding sleeve tool assembly to move the sleeve of the first single fluid line sliding sleeve downhole tool assembly from a closed position to an open position while maintaining the sleeve of a second single fluid line sliding sleeve assembly in a closed position; and allowing injection fluid to move into tubing, through the production port, into the annulus, and into a reservoir.

9. The method of claim 8, wherein from two to twenty-five single fluid line sliding sleeve downhole tool assemblies are provided sequentially in the well and are independently operable.

10. The method of claim 8, wherein the injection fluid is a compressible fluid or a non-compressible fluid.

11. The method of claim 8, wherein the injection fluid is a member of the group consisting of: sea water, water produced from the well, a hydrocarbon, carbon dioxide, nitrogen, and combinations thereof.

12. The method of claim 8, wherein the first pressure ranges from 5000 psi to 20,000 psi.

13. The method of claim 8, further comprising venting fluid from the body to the annulus, the surface, the tubing, or combinations thereof using a relief valve.

14. The method of claim 8, wherein the well is connected to a hydrocarbon bearing subterranean reservoir and the at least two single fluid line sliding sleeve downhole tool assemblies are part of a production tubing string for producing hydrocarbons from the reservoir through the at least two single fluid line sliding sleeve downhole tool assemblies and into an inner portion of the production tubing string.

15. The method claim 8, further comprising pluralities of at least three operationally connected single fluid line sliding sleeve downhole tool assemblies connected in series.

16. The method of claim 15, wherein a first of the operationally connected pluralities operates independently of at least a second of the operationally connected pluralities.

17. The method of claim 8, further comprising the step of applying a second pressure from the fluid source simultaneously to each of the single fluid line sliding sleeve downhole tool assemblies to move at least one sleeve from the open position to the closed position.

18. The method of claim 8, further comprising the step of applying a second pressure from the fluid source simultaneously to each of the at least two single fluid line sliding sleeve down hole tool assemblies to move simultaneously the sleeve of a first single fluid line sliding sleeve downhole tool assembly from the open position to the closed position while moving the sleeve from a second single fluid line sliding sleeve downhole tool assembly from the closed position to the open position.

19. A method for producing a wellbore fluid from an oil, natural gas, or water reservoir, the method comprising;

providing at least one single fluid line sliding sleeve downhole tool assembly into a well in a closed position, wherein the at least one single fluid line sliding sleeve downhole tool assembly comprises:

a top sub engaging a top connector which connects to a body that engages a middle connector which is secured to a port housing, wherein the port housing engages a lower connector and the lower connector engages a bottom sub;

a sleeve with a production port for axially moving with respect to the body;

an annulus port disposed in the port housing for communicating fluid between an annulus and tubing in the sleeve;

a first seal assembly providing a sealing engagement between the sleeve and the top connector;

a second seal assembly providing a sealing engagement between the middle connector and the sleeve;

a third seal assembly providing a sealing engagement between the port housing and the sleeve;

a first piston in communication with a fluid source and wherein the first piston moves axially between at least an original position and at least a secondary position;

a second piston in communication with the fluid source and wherein the second piston moves axially between at least a second piston original position and at least a second piston secondary position; and wherein the first piston moves the sleeve in a first direction and the second piston moves the sleeve in a second direction;

at least one logic drum linearly disposed between the body and the sleeve for rotating and translating alternatingly between the first piston and the second piston;

a means for actuating the first piston and the second piston;

a first relocating device for relocating the first piston from the secondary position to the original position and a second relocating device for relocating the second piston from the second piston secondary position to the second piston original position;

applying a first pressure from the fluid source simultaneously to the first piston and the second piston enabling the first piston and the second piston to move the sleeve from the closed position to an open position; and allowing reservoir fluid to move from the reservoir into the annulus then through the production port into a production flow line.

20. The method of claim 19, wherein the first pressure ranges from 5000 psi to 20,000 psi.

21. The method of claim 19 further comprising venting fluid from the body to the annulus, the surface, the tubing, or combinations thereof using a relief valve.

22. The method of claim 19, further comprising the step of applying a second pressure from the fluid source simultaneously to the first piston and the second piston enabling the first piston and the second piston to move the sleeve from the open position to the closed position.

23. A method for producing a wellbore fluid from an oil, natural gas or water reservoir, the method comprising:

providing at least two single fluid line sliding sleeve downhole tool assemblies into a well in a closed position, each of the at least two single fluid line sliding sleeve downhole tool assemblies comprising:

a top sub engaging a top connector which connects to a body that engages a middle connector which is secured to a port housing, wherein the port housing engages a lower connector and the lower connector engages a bottom sub;

a sleeve with a production port for axially moving with respect to the body;

an annulus port disposed in the port housing for communicating fluid between an annulus and tubing in the sleeve;

a first seal assembly providing a sealing engagement between the sleeve and the top connector;

a second seal assembly providing a sealing engagement between the middle connector and the sleeve;

a third seal assembly providing a sealing engagement between the port housing and the sleeve;

a first piston in communication with a fluid source and wherein the first piston moves axially between at least an original position and at least a secondary position;

a second piston in communication with the fluid source and wherein the second piston moves axially between at least a second piston original position and at least a second piston secondary position; and wherein the first piston moves the sleeve in a first direction and the second piston moves the sleeve in a second direction;

at least one logic drum linearly disposed between the body and the sleeve for rotating and translating alternatingly between the first piston and the second piston;

a means for actuating the first piston and the second piston; and a first relocating device for relocating the first piston from the secondary position to the original position and a second relocating device for relocating the second piston from the second piston secondary position to the second piston original position;

applying a first pressure from the fluid source simultaneously to the first piston and the second piston of each at least two single fluid line sliding sleeve downhole tool assemblies enabling the first piston and the second piston of a first single fluid line sliding sleeve tool assembly to move the sleeve of the first single fluid line sliding sleeve downhole tool assembly from a closed position to an open position while maintaining the sleeve of a second single fluid line sliding sleeve assembly in a closed position; and allowing reservoir fluid to move from the reservoir into the annulus then through the production port into a production flow line.

24. The method of claim 23, wherein the first pressure ranges from 5000 psi to 20,000 psi.

25. The method of claim 23 further comprising venting fluid from the body to the annulus, the surface, the tubing, or combinations thereof using a relief valve.

26. The method of claim 23, further comprising the step of applying a second pressure from the fluid source simultaneously to each of the single fluid line sliding sleeve downhole tool assemblies to move at least one sleeve from the open position to the closed position.

27. The method of claim 23, further comprising the step of applying a second pressure from the fluid source simultaneously to each of the at least two single fluid line sliding sleeve down hole tool assemblies to move simultaneously the sleeve of a first single fluid line sliding sleeve downhole tool assembly from the open position to the closed position while moving the sleeve from a second single fluid line sliding sleeve downhole tool assembly from the closed position to the open position.

* * * * *